United States Patent [19]

Suzuki et al.

[11] Patent Number: 4,688,997

[45] Date of Patent: Aug. 25, 1987

[54] VARIABLE DISPLACEMENT COMPRESSOR WITH VARIABLE ANGLE WOBBLE PLATE AND WOBBLE ANGLE CONTROL UNIT

[75] Inventors: Shinichi Suzuki; Kenji Takenaka; Masaki Ohta, all of Kariya, Japan

[73] Assignee: Kabushiki Kaisha Toyoda Jidoshokki Seisakusho, Aichi, Japan

[21] Appl. No.: 839,908

[22] Filed: Mar. 14, 1986

[30] Foreign Application Priority Data

Mar. 20, 1985 [JP] Japan ..... 60-56422
Jun. 13, 1985 [JP] Japan ..... 60-129362

[51] Int. Cl.[4] ..... F04B 1/26
[52] U.S. Cl. ..... 417/222; 417/270
[58] Field of Search ..... 417/222, 269, 270

[56] References Cited

U.S. PATENT DOCUMENTS

| | | | |
|---|---|---|---|
| 3,861,829 | 1/1975 | Roberts et al. | 417/270 X |
| 4,037,993 | 7/1977 | Roberts | 417/222 |
| 4,145,163 | 3/1979 | Fogelberg et al. | 417/222 |
| 4,428,718 | 1/1984 | Skinner | 417/222 |
| 4,526,516 | 7/1985 | Swain et al. | 417/222 |
| 4,533,299 | 8/1985 | Swain et al. | 417/222 |
| 4,586,874 | 5/1986 | Hiraga et al. | 417/222 |

FOREIGN PATENT DOCUMENTS 2155116 9/1985 United Kingdom ..... 417/222

*Primary Examiner*—Carlton R. Croyle
*Assistant Examiner*—Paul F. Neils
*Attorney, Agent, or Firm*—Burgess, Ryan and Wayne

[57] ABSTRACT

A variable displacement compressor with a variable angle non-rotary wobble plate, having a suction chamber for refrigerant before compression, a discharge chamber for refrigerant after compression, suction and compression cylinders, pistons reciprocating in the cylinders, a crankcase receiving therein a wobble plate mechanism connected to pistons to cause reciprocating motion of the pistons and capable of changing the wobble angle thereof, a first passage for communicating the crankcase interior with the discharge chamber, a shutoff valve unit for closing and opening the first passage, a second passage for communicating the crankcase interior with the suction chamber to extract the refrigerant from the crankcase interior into the suction chamber, and a valve control unit for controlling the operation of the shutoff valve unit in response to a change in a fluid pressure in the crankcase interior with respect to a predetermined pressure level thereby controlling the wobble angle of the wobble plate mechanism.

14 Claims, 9 Drawing Figures

VARIABLE DISPLACEMENT COMPRESSOR WITH VARIABLE ANGLE WOBBLE PLATE AND WOBBLE ANGLE CONTROL UNIT

BACKGROUND OF THE INVENTION

1. Field of the Invention

The present invention relates to a variable angle wobble plate type compressor with a unit for changing compressor displacement. More particularly, the present invention relates to a variable angle wobble plate type compressor including a suction chamber, a discharge chamber, and a crankcase, wherein a piston stroke is varied according to a pressure difference between a suction pressure and a crankcase pressure to change the inclination of the wobble plate, thereby controlling the compressor displacement.

2. Description of the Related Art

An example of a conventional variable displacement compressor applicable for an air conditioning system of a vehicle is disclosed in U.S. Pat. No. 4,428,718 to Skinner. This compressor is provided with a bellows in a suction chamber to detect suction pressure. When the suction pressure decreases below a predetermined value due to a decrease in a cooling load or due to a high-speed rotation of the compressor, the bellows is expanded according to the variation of balance between the suction pressure and atmospheric pressure to actuate a valve mechanism. A communication passage between the crankcase and suction chamber is then closed and a communication passage between a discharge chamber and the crankcase is opened, to increase the crankcase pressure so that the pressure difference between the crankcase pressure and suction pressure will be increased. As a result, a piston stroke is reduced to reduce the inclination of a wobble plate which causes the piston to reciprocate, so that the suction pressure will be prevented from falling below a predetermined value, and the compressor displacement will be reduced.

However, when the suction pressure is temporarily decreased due to, for instance, a sudden acceleration, the bellows of the conventional variable displacement compressor mentioned above rapidly detects the change of suction pressure and actuates the valve mechanism, causing a high-pressure discharge gas to be sent into the crankcase and excessively increasing the crankcase pressure; although, in such a sudden acceleration, the piston stroke is automatically reduced according to the decrease of suction pressure, to start a small displacement operation without the need to increase the crankcase pressure. Due to the above, even if the revolution speed is decreased after the sudden acceleration operation, the pressure difference between the suction chamber and crankcase is small due to the reduction of the number of revolutions, and the pressure in the suction chamber is increased by the insufficient displacement in the small displacement operation, so that the excessively heightened pressure in the crankcase can be reduced only gradually and the small displacement operation will be continued with the reduced piston stroke. As a result, the temperature in a vehicle cabin rises. To lower the temperature to an optimum value, the inclination of the wobble plate must be once returned to the maximum inclination, i.e., a delay occurs before the optimum temperature can be reached. Further, the bearing pressure at the shaft seal is increased because the crankcase pressure is excessively increased for every sudden acceleration, causing a problem in that the durability of the shaft seal mechanism is lowered.

SUMMARY OF THE INVENTION

An object of the present invention is to eliminate the above-mentioned problems encountered by the conventional variable inclination wobble plate type compressor.

Another object of the present invention is to provide a variable inclination wobble plate type compressor provided with a novel control means for controlling a compressor displacement, in which the pressure in crankcase interior or chamber is kept substantially at a predetermined constant value during ordinary operation of the compressor, and the piston stroke of the compressor is controlled according to a pressure difference between the pressure in the crankcase interior, which is kept substantially at the constant value, and the suction pressure which varies according to a change in the cooling load, etc.

A further object of the present invention is to provide a variable wobble plate type compressor with the above mentioned novel control means for controlling a compressor displacement, in which, when the compressor is applied to an air conditioning system of a vehicle, the full displacement operation of the compressor is rapidly resumed when the compressor is suddenly decelerated due to the sudden operation of an engine brake of the vehicle and returned to a constant speed operation after releasing the engine brake, or when the compressor is suddenly accelerated due to a sudden acceleration of the vehicle and then returned to the constant speed operation.

In accordance with the present invention, there is provided a variable displacement wobble plate type compressor comprising:

a suction chamber for a refrigerant, a plurality of cylinder bores arranged so as to surround an axial drive shaft and having therein associated reciprocatory pistons disposed so as to draw the refrigerant from the suction chamber and to then discharge the refrigerant after compression in the discharge chamber, a crankcase having defined therein a chamber communicating with the cylinder bores and containing therein a drive plate mounted in such a manner that it is capable of rotating with the axial drive shaft as well as changing an inclination thereof with respect to the axial drive shaft and a non-rotating wobble plate held by the drive shaft, a plurality of connecting rods connecting between the wobble plate and pistons, a first passageway for communicating the chamber of the crankcase with the discharge chamber, a first valve unit arranged in the first passageway, for opening and closing the first passageway, a second passageway for fluidly communicating the crankcase chamber with the suction chamber, and; a valve control unit for controlling the operation of the first valve unit in response to a change in fluid pressure in the crankcase chamber with respect to a predetermined pressure level, the valve control unit moving the first valve unit to a first position opening the first passageway when pressure in the crankcase chamber is less than the predetermined pressure level, and to a second position closing the first passageway when the pressure in the crankcase chamber is larger than the predetermined pressure level. Further, the variable displacement compressor may comprise a second valve unit arranged in the second passageway, for opening and closing the second passageway, the second valve unit being operatively connected to the valve control unit, the valve control unit moving the second valve unit to a first position narrowing the second passageway when pressure in the crankcase chamber is less than the predetermined pressure level, and to a second position expanding the second passageway when the pressure in the crankcase chamber is larger than the predetermined pressure level.

BRIEF DESCRIPTION OF THE DRAWINGS

Other objects, features and advantages of the present invention will be made more apparent from the ensuing description of the embodiments of the present invention with reference to the accompanying drawings, wherein.

DESCRIPTION OF THE PREFERRED EMBODIMENTS

The constitutions of embodiments according to the present invention will now be described with reference to the accompanying drawings.

Figure 1:
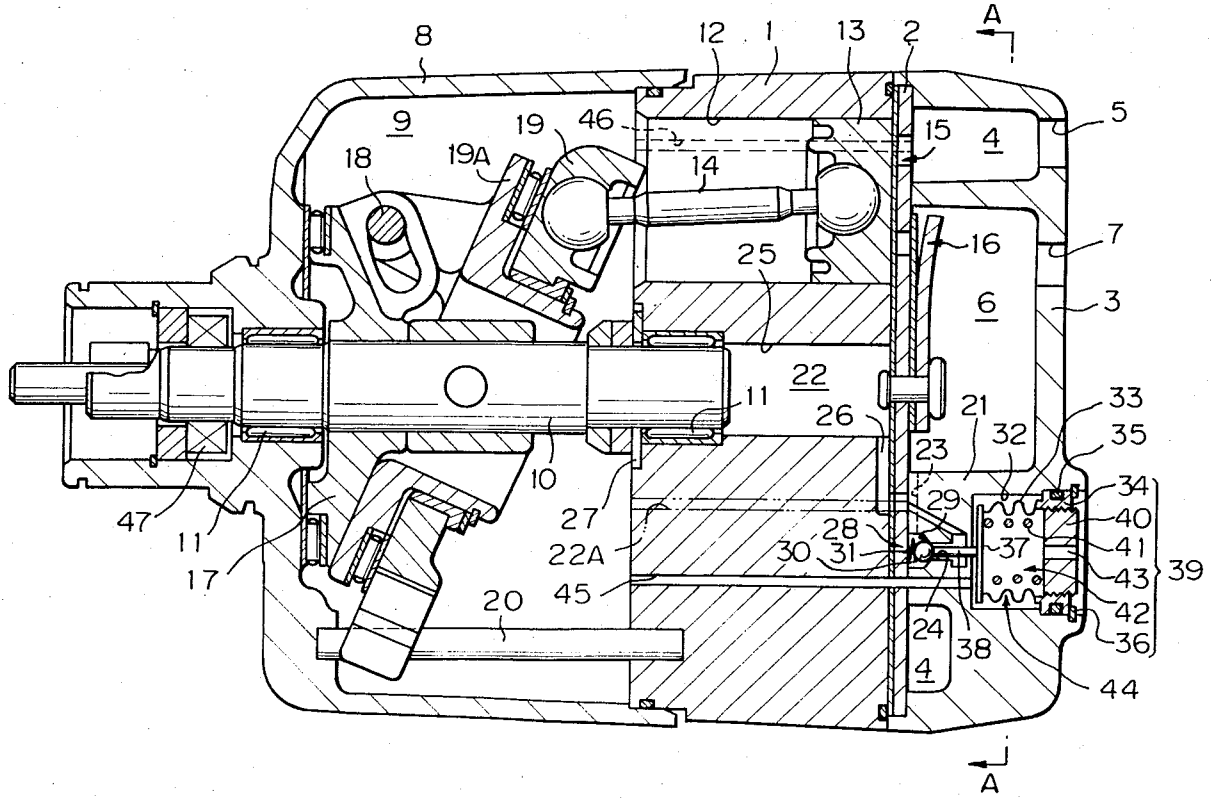
FIG. 1 is a longitudinal cross-sectional view showing a compressor according to the first embodiment of the present invention.

A first embodiment discloses a variable displacement compressor with a variable angle wobble plate and is applicable for an air conditioning system of a vehicle. As shown in FIG. 1, a cylinder block 1 is provided on its right end face with a valve plate 2 through which a compressor head 3 is connected and fixed to the cylinder block 1 with a proper fastening means. An annular suction chamber 4 is formed along the inner circumference of head 3, and a discharge chamber 6 is formed at a central portion of the head 3. The suction chamber 4 and discharge chamber 6 are separated from one another and connected with an external cooling circuit through a suction port 5 and a discharge port 7 respectively. The left end face of cylinder block 1 is connected and fixed to a crankcase 8. The interior or chamber 9 of the crankcase 8 receives a wobble plate 19 to be described later. The cylinder block 1 and crankcase 8 rotatably support a drive shaft 10 through a pair of bearings 11 and a shaft seal mechanism 47.

Figure 3:
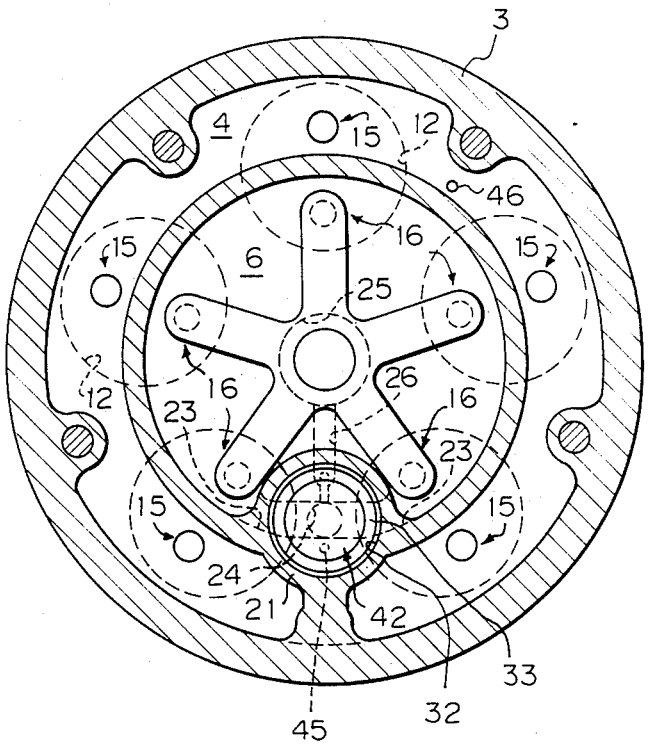
FIG. 3 is a cross-sectional view taken along the line A—A shown in FIG. 1.

The cylinder block 1 has five axial cylinder bores 12 (FIG. 3) formed to pass through both ends of the cylinder block 1 in parallel with the drive shaft 10. A piston 13 is disposed in each cylinder bore 12 to reciprocate slidably therein. The left end face of each piston 13 is connected to a piston rod 14. The valve plate 2 is provided with a suction valve mechanism 15 formed to introduce refrigerant gas from the suction chamber 4 into a compression chamber of each cylinder bore 12. The valve plate 2 is also provided with a discharge valve mechanism 16 for exhausting the refrigerant gas compressed in the compression chamber of each cylinder bore 12 into the discharge chamber 6.

The drive shaft 10 is fixedly coupled with a drive element 17. The drive element 17 is connected to a drive plate 19A by a connecting pin 18. The drive plate 19A rotates together with the drive element 17 and is able to incline with respect to the drive shaft 10. The drive plate 19A supports a wobble plate 19 which is also able to incline with respect to the drive element 17 but the rotation thereof is restricted by a guide rod 20 supported horizontally at a predetermined location. The wobble plate 19 is linked with the left end portion of each piston rod 14 by a ball and socket joint. When the drive shaft 10 is rotated to turn the drive element 17, the wobble plate 19 is inclined and the pistons 13 reciprocated via the piston rods 14. According to a pressure difference between suction pressure in the suction chamber 4 and a pressure in the crankcase interior 9, the stroke of each piston 13 will vary to change the inclination of the wobble plate 19, thereby controlling the compressor displacement.

The above-mentioned constitution of a compressor is the same as that of the conventional variable displacement compressor.

The featured portions of the present invention will now be described. A partition wall separating the discharge chamber 6 and the suction chamber 4 in the head 3 is provided at its lower part with a swelled portion 21 formed solidly therewith. The discharge chamber 6 and the crankcase interior 9 communicate with each other through a gas passage 22 provided therebetween. The gas passage 22 comprises a passage 23 provided on one side facing the valve plate 2 of the swelled portion 21 and communicates with the lowest portion of discharge chamber 6; a passage 24 formed at the central part of the swelled portion 21 and extends laterally to communicate with the passage 23; a bearing bore 25 formed at the central part of cylinder block 1 to receive the drive shaft 10; a passage 26 formed through the swelled portion 21, valve plate 2, and cylinder block 1 to communicate with the passage 24 and bearing bore 25; a clearance gap within the bearing 11; and a passage 27 formed on the left end face of cylinder block 1. The bearing bore 25 and passages 26 and 27 of the gas passage 22 may be substituted by providing a passage 22A which starts in the middle of passage 26 and passes laterally through the cylinder block 1 as indicated by a two-dot chain line in FIG. 1. At a boundary between the passages 23 and 24, a shutoff valve 28 is provided to open and close the gas passage 22. The shutoff valve 28 comprises a valve seat 29 formed at the left end portion of lateral passage 24; a ball valve 30 disposed so as to come into removable contact with the valve seat 29; and a spring 31 biasing the ball valve 30 toward a closing position against the valve seat 29.

The swelled portion 21 of the head 3 incorporates a valve control unit 39 for controlling the opening and closing of the shutoff valve 28. The constitution of the control unit 39 will now be described. A receiving recess 32 is formed in alignment with the passage 24, with an opening toward atmosphere. The recess 32 receives a bellows 33 having a clamping ring 34 at the base end thereof. The clamping ring 34 abuts against the inner circumference of the recess 32 via an O-ring 35 and is held at a predetermined position by means of a snap ring 36. An actuating rod 38 is provided at a central part of an end plate 37 provided at the front end of bellows 33.

A spring receiver 40 is screw-fixed to the inner circumference of the clamping ring 34. A spring 41 is placed between the end plate 37 and the spring receiver 40 to bias the actuating rod 38 against the ball valve 30. The spring receiver 40 is provided with a passage 43 for communication between the inner space of the bellows 33 and the atmosphere, and forms an atmospheric chamber 42. The receiving recess 32, bellows 33, clamping ring 34, end plate 37, etc., form a separated pressure sensitive chamber 44 which communicates with the crankcase interior 9 via a connecting passage 45 passing laterally through the cylinder block 1, valve plate 2, and swelled portion 21.

In this embodiment, if pressure in the crankcase interior 9 is larger than a set value (for instance, 2.5 atm), pressure in the pressure sensitive chamber 44 overcomes the resultant force of the spring 41 and atmospheric pressure so that the actuating rod 38 will be moved to the right to close the shutoff valve 28. On the other hand, if the pressure in the crankcase interior 9 becomes lower than the set value, the force acting on the actuating rod 38 is inverted and the shutoff valve 28 allowed to open.

An extraction passage 46 passes laterally through the cylinder block 1 and valve plate 2 for communication between the crankcase interior 9 and suction chamber 4. By virtue of the extraction passage 46, the refrigerant gas sent from the compression chamber of each cylinder bore 12 into the crankcase interior 9 due to a blowby is returned to the suction chamber 4 so that any pressure increase in the crankcase interior 9 can be suppressed.

The operation of the so constituted variable displacement compressor will now be described.

Figure 2A:
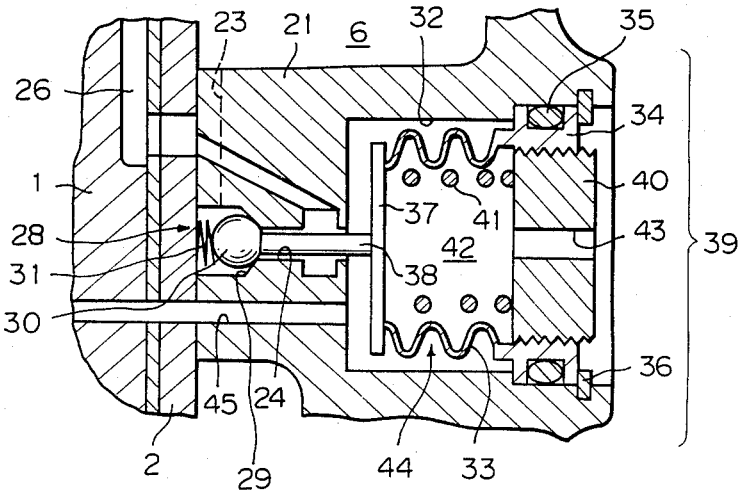
FIG. 2A is an enlarged cross-sectional view showing a closed state of a valve control unit.

During a halt in compressor operation, pressure (for instance, 4 atm) in the crankcase interior 9 is larger than a set value (for instance, 2.5 atm). Accordingly, as shown in FIGS. 1 and 2A, the actuating rod 38 is located at a valve closed position where the ball valve 30 of the shutoff valve 28 is seated against the valve seat 29 to close the gas passage 22. When the drive shaft 10 is rotated by the driving force of a vehicle engine, the wobble plate 19 is inclined without being rotated by the drive element 17 and connecting pin 18. Accordingly, the pistons 13 are reciprocated via piston rods 14 to suck the refrigerant gas from the suction chamber 4 through the suction valve mechanism 15 into the compression chambers of the cylinder bores 12. The refrigerant gas is compressed in the compression chambers, and exhausted under pressure through the discharge valve mechanism 16 into the discharge chamber 6.

On the other hand, due to a blowby, the refrigerant gas is sent from the compression chamber of each cylinder bore 12 through a gap between the inner circumferential face of each cylinder bore 12 and the peripheral face of each piston 13 into the crankcase interior 9. This blowby refrigerant gas is sent from the crankcase interior 9 back to the suction chamber 4 through the extraction passage 46, which is always open. If cooling load is large at a compressor starting stage due to a high temperature in a vehicle cabin to be cooled, pressure (for instance, 4 atm) in the crankcase interior 9 is slightly higher than suction pressure to keep the pressure difference therebetween below a predetermined value so that the pistons 13 will be reciprocated at the maximum stroke to perform a full compressor displacement operation, with the inclination of the wobble plate 19 being kept at large value.

Figure 2B:
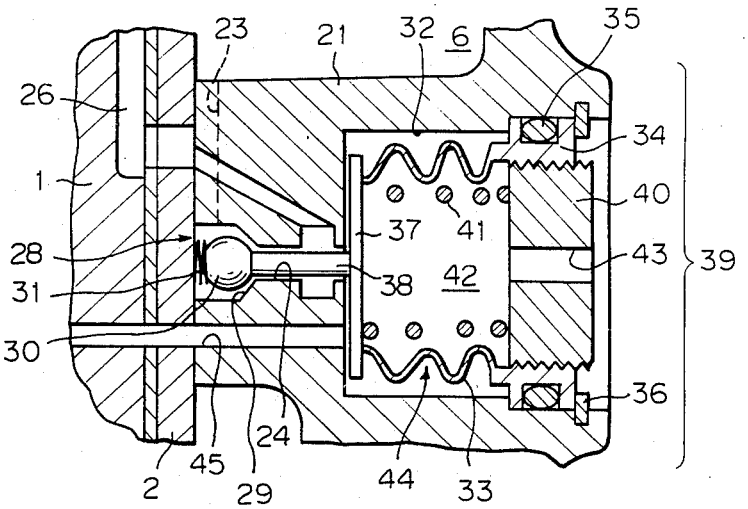
FIG. 2B is an enlarged cross-sectional view showing an open state of the valve control mechanism.

The operation of the compressor is continued in such a manner. If the temperature in the vehicle cabin is lowered to reduce the cooling load, the suction pressure is decreased and the pressure in the crankcase interior 9 lowered. If the pressure in the crankcase interior 9 is lowered below a set value (2.5 atm), the pressure in the pressure sensitive chamber 44 is lowered accordingly, so that the bellows 33 will be extended by the spring 41. The actuating rod 38 then pushes the ball valve 30 to remove the ball valve 30 from the valve seat 29, thereby opening the gas passage 22 as shown in FIG. 2B. As a result, discharge gas flows from the discharge chamber 6 into the crankcase interior 9 through the gas passage 22 to stop the lowering of pressure in crankcase interior 9.

At this moment, the gas which flows from the discharge chamber 6 through the gas passage 22 into the crankcase interior 9 is choked by a clearance gap in the bearing 11, so that the pressure in crankcase interior 9 will be gradually increased. If the pressure in crankcase interior 9 due to the gas flow from the gas passage 22 exceeds the set value, the actuating rod 38 is moved toward the valve closing position, and the ball valve 30 is pressed against the valve seat 29 by the spring 31 to close the gas passage 22, thereby stopping the pressure increase in the crankcase interior 9. As a result, the pressure in the crankcase interior 9 is automatically kept substantially at the set value during an ordinary operation of the compressor.

If the temperature in the vehicle cabin is decreased to further reduce the cooling load, the suction pressure is lowered regardless of the pressure in the crankcase interior 9, which is kept substantially at the set value, and if the pressure difference between the pressure in crankcase interior 9 and the suction pressure exceeds a predetermined value (for instance 0.5 atm), the stroke of each piston 13 is reduced to reduce the inclination of the wobble plate 19, thereby changing the operation mode to a small compressor displacement operation.

If a vehicle engine is suddenly accelerated during the ordinary operation to suddenly increase the revolution speed of the drive shaft 10, the suction pressure is lowered and the pressure difference between the pressure in the crankcase interior 9 and the suction pressure is increased to reduce the stroke of each piston 13, thereby reducing the compressor displacement. In this case, the shutoff valve 28 is not influenced by the suction pressure so that the pressure in crankcase interior 9 is not excessively raised. If the sudden acceleration of the engine is stopped to reduce the revolution speed of the drive shaft 10, the stroke of each piston 13 is increased according to the increase of suction pressure, thereby increasing the compressor displacement.

In the present invention, the atmospheric chamber 42 may be substituted by a vacuum chamber (not shown), and the bellows 33 may be substituted by a diaphragm (not shown).

As is apparent from the above description of the operation of the embodiment, in a compressor operating state where a shutoff valve closes a gas passage, refrigerant gas sent from a compression chamber of each cylinder bore into a crankcase interior due to blowby is returned, according to the present invention, to a suction chamber through an extraction passage. If the temperature in a vehicle cabin is lowered to reduce the cooling load, and if the pressure in the crankcase interior falls below a set value in accordance with the lowering of the suction pressure, a valve control mechanism opens the shutoff valve to allow the high-pressure gas to flow from the discharge chamber into the crankcase interior, thereby increasing the pressure in the crankcase interior. If the pressure in the crankcase interior becomes higher than the set value, the valve control mechanism closes the shutoff valve to close the gas passage, thereby stopping an increase in the pressure in the crankcase interior. As a result, the pressure in the crankcase interior is always kept substantially at the set value during ordinary operation. Therefore, the stroke of the pistons can be controlled according to a pressure difference between the substantially fixed pressure in the crankcase interior and the suction pressure, which varies according to the change of the cooling load, etc., and thus it is possible to control the compressor displacement.

On the other hand, if the suction pressure is temporarily lowered at the time of a sudden acceleration, the pressure in the crankcase interior is kept substantially at the set value so that the piston stroke can be regulated by the pressure difference between the pressure in the crankcase interior and the suction pressure, to temporarily reduce the inclination of the wobble plate and reduce the compressor displacement. If the sudden acceleration is stopped, to cause an increase in the suction pressure, the pressure difference is decreased accordingly so that the previous inclination of the wobble plate will be promptly regained.

As a result, the compressor according to the present invention can maintain the pressure in the crankcase interior substantially at the constant set value during the ordinary operation of the compressor, regardless of the suction pressure. Even if temporarily subjected to a sudden acceleration, the pressure in the crankcase interior will not be excessively increased so that the operating time of a shaft seal with a low bearing pressure will be extended, to improve the durability of the shaft seal mechanism. Since the suction pressure is lowered at the time of a sudden acceleration, the pressure difference between the pressure in the crankcase interior and the suction pressure becomes larger, to reduce the stroke to each piston and reduce the displacement of the compressor. If the sudden acceleration is completed and thus the number of revolutions lowered, the pressure difference becomes smaller according to the increase of the suction pressure because the pressure in the crankcase interior is kept substantially at a fixed value. Accordingly, the compressor displacement is rapidly returned to an original state, thereby improving the rapid cooling characteristic after the completion of a sudden acceleration. Even if the sudden acceleration is performed at the time of an engine startup, the pressure in the crankcase interior will not be excessively increased so that the compressor displacement will rapidly return to its original state after the completion of a sudden acceleration to improve the cooling-down characteristic.

The second embodiment of a compressor according to the present invention will now be described with reference to the FIGS. 4 to 7. The second embodiment includes a valve control unit which has been improved based on the valve control unit of a variable displacement compressor having a variable angle wobble plate according to the first embodiment of the present invention mentioned above. In FIGS. 4 to 7, identical and like elements shown in the first embodiment will be presented by adding 100 to the former numerals.

Figure 4:
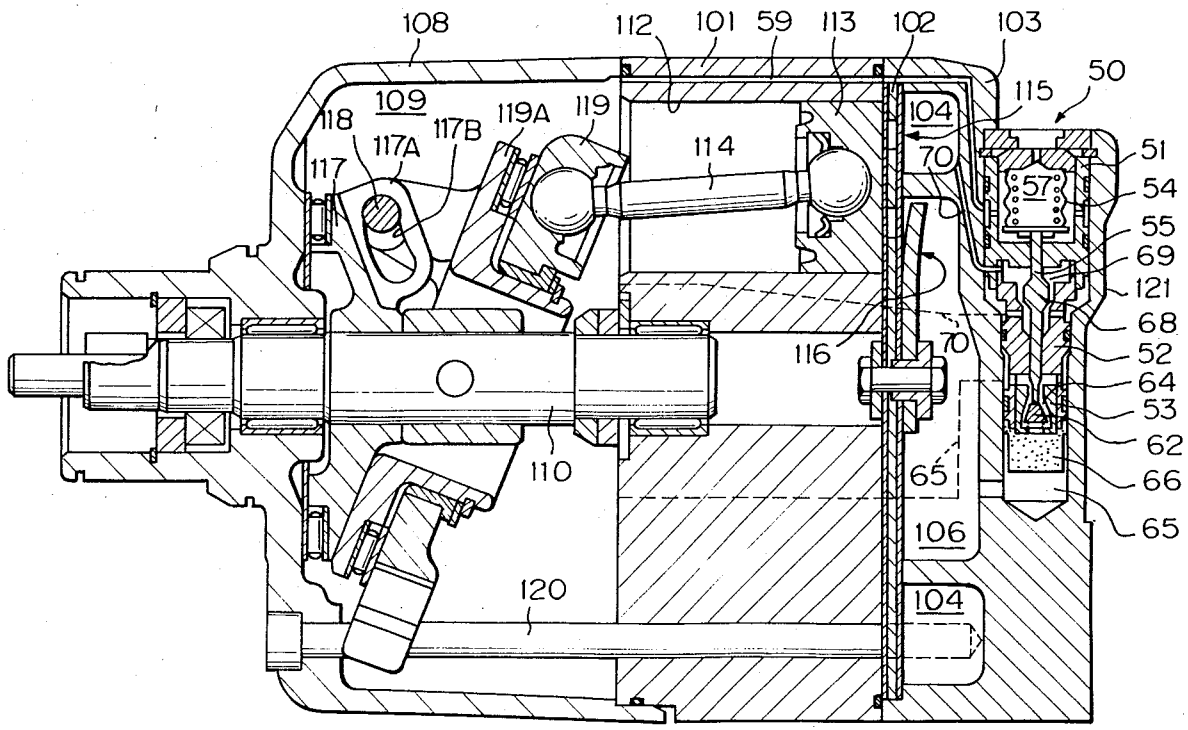
FIG. 4 is a longitudinal cross-sectional view showing a compressor according to the second embodiment of the present invention.

Referring to FIG. 4, the cylinder block 101 is provided on its right end face with a valve plate 102 through which a compressor head 103 is connected and fixed to the cylinder block 101. An annular suction chamber 104 is formed along the inner circumference of the head 103, and a discharge chamber 106 is formed at a central portion of the head 103. The suction chamber 104 and discharge chamber 106 are separated from one another and connected by an external cooling circuit through suction and discharge ports (not shown) respectively. The left end face of the cylinder block 101 is connected and fixed to a crankcase 108. The interior 109 of the crankcase 108 receives a wobble plate 119. The cylinder block 101 and crankcase 108 rotatably support a drive shaft 110.

The cylinder block 101 has six cylinder bores 112 (only one is shown) formed to pass through both ends of the cylinder block 101 in parallel with the drive shaft 110. A piston 113 is disposed in each cylinder bore 112 to reciprocate slidably therein. The left end face of the piston 113 is connected to a piston rod 114 by a ball and socket joint. The valve plate 102 is provided with a suction valve mechanism 115 formed to introduce refrigerant gas from the suction chamber 104 into a compression chamber of each cylinder bore 112. The valve plate 102 is also provided with a discharge valve mechanism 116 for exhausting the refrigerant gas compressed in the compression chamber of cylinder bores 112 into the discharge chamber 106.

The drive shaft 110 is fixedly coupled with a drive element 117. A long hole 117B formed on a projection 117A projecting from the drive element 117 engages with a drive plate 119A through a connecting pin 118. The drive plate 119A rotates together with the drive element 117 and is able to incline with respect to the drive shaft 110 and the drive element 117.

The drive plate 119A is provided with the wobble plate 119 which is able to incline together with the drive plate 119A with respect to the drive shaft 110 but the rotation thereof is restricted by a guide rod 120 supported horizontally at a predetermined location. The wobble plate 119 is linked with the left end portions of the piston rods 114 by a ball and socket joint. When the drive shaft 110 is rotated to turn the drive element 117, the wobble plate 119 will be inclined to reciprocate the pistons 113 via the piston rods 114. According to a pressure difference between the suction pressure in the suction chamber 104 and the pressure in the crankcase 108, the stroke of the pistons 113 will vary to change the inclination of the wobble plate 119, thereby controlling the compressor displacement.

The featured portion of the embodiment will now be described.

Figure 5:
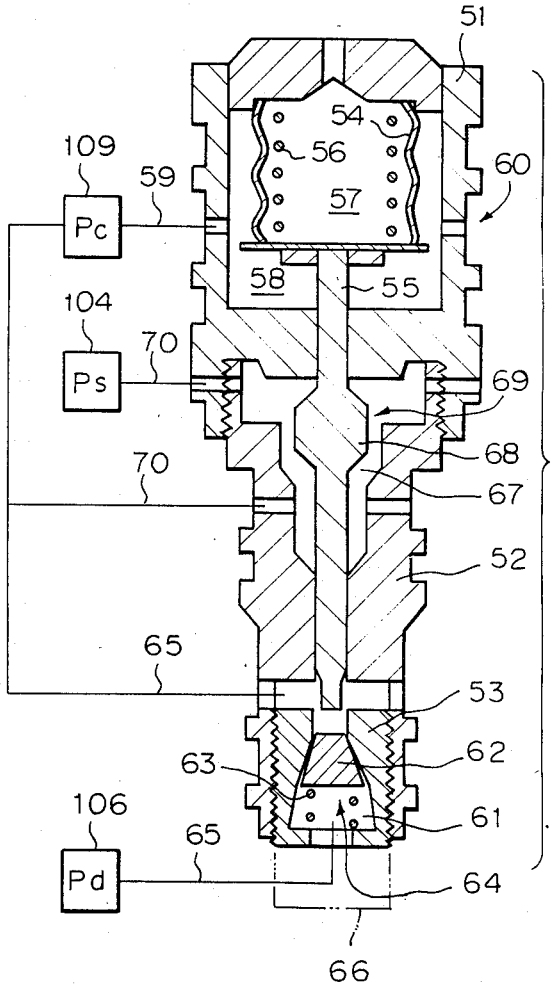
FIG. 5 is an enlarged cross-sectional view showing a control unit.

On the back face of the head 103, a swelled portion 121 is solidly formed which fixedly incorporates a control valve 50 for maintaining the pressure in the crankcase interior 109 substantially at a predetermined constant value. the control valve 50 will now be described mainly with reference to FIG. 5. A first cylindrical casing 51 having covered top and bottom portions has a cylindrical second casing 52, the upper end peripheral portion of which is screw-fixed to the inside of the lower end portion of the first casing 51. A third cylindrical casing 53 is screw-fixed to the inside of the lower end portion of the second casing 52.

A bellows 54 is received inside the first casing 51. The front end of the bellows 54 is fitted to the upper end of an actuating rod 55 which passes through the second casing 52 and extends into the third casing 53. The actuating rod 55 is biased downward by a spring 56 received inside the bellows 54.

An atmospheric chamber 57 is formed inside the bellows 54 and communicates with the atmosphere. Between the bellows 54 and the first casing 51, a pressure sensitive chamber 58 is formed for detecting a pressure Pc, i.e., pressure in the crankcase interior 109. The pressure sensitive chamber 58 communicates with the crankcase interior 109 through a connecting passage 59 formed in the cylinder block 101, head 103, and first casing 51. In the present embodiment, the first casing 51, bellows 54, actuating rod 55, spring 56, atmospheric chamber 57, pressure sensitive chamber 58, connecting passage 59, etc., constitute a valve control mechanism 60 which controls the first and second shutoff valves 64 and 69 as described later.

The third casing 53 is provided therein with the first shutoff valve 64 comprising a valve chest 61; a frustoconical valve element 62 incorporated within the valve chest 61 and operated to an open position by the actuating rod 55; a spring 63 which biases the valve element 62 toward a closed position with a force slightly weaker than that of the spring 56 of the valve control mechanism 60. The first shutoff valve 64 is disposed in the middle of a gas passage 65 which communicates between the discharge chamber 106 and the crankcase interior 109 and controls the supply of gas from the discharge chamber 104 to the crankcase interior 109. A filter 66 is provided on the bottom face of the third casing 53 to remove impurities from gas flowing through the gas passage 65.

The second shutoff valve 69 is disposed inside the second casing 52 comprising a valve chest 67, and a valve element 68 formed solidly with the actuating rod 55 at the middle portion thereof. The second shutoff valve 69 is arranged in the middle of an extraction passage 70 which communicates between the crankcase interior 109 and the suction chamber 104. By controlling the opening of the second shutoff valve 69, the flow of refrigerant gas sent from the crankcase interior 109 back to the suction chamber 104 can be adjusted.

In this embodiment, if the pressure Pc of the crankcase interior 109 is larger than a set value (for instance, 2.7 atm), the pressure in the pressure sensitive chamber 58 becomes larger than the resultant force of the force of spring 56 and the atmospheric pressure so that the actuating rod 55 will be pushed upward to close the first shutoff valve 64 and extend the opening of the second shutoff valve 69. On the contrary, if the pressure in crankcase interior 109 is smaller than the set value, the direction of force acting on the actuating rod 55 is inverted to open the first shutoff valve 64 and make narrower the opening of second shutoff valve 69.

The operation of the so constituted variable displacement compressor will now be described.

If the temperature in a vehicle cabin to be cooled is high and the cooling load is large at a compressor starting stage, the pressure Pc (for instance, 4 atm) in the crankcase interior 109 is slightly higher than the suction pressure Ps, and a pressure difference $\Delta p$ (Pc−Ps) is kept below a predetermined value so that the pistons 113 may be reciprocated at the maximum stroke to perform a full compressor displacement operation with the inclination of wobble plate 119 being large. Under this condition, as shown in FIG. 5, the pressure Pc in the crankcase interior 109 exceeds the set pressure (2.7 atm) to increase the pressure in the pressure sensitive chamber 58. The actuating rod 55 is moved upward to close the gas passage 65 by the shutoff valve 64, and the supply of gas from the discharge chamber 106 to the crankcase interior 109 is stopped, while the opening of second shutoff valve 69 is enlarged to rapidly move the gas between the crankcase interior 109 and the suction chamber 104.

Then, if the temperature in the vehicle cabin is lowered to reduce the cooling load, the suction pressure Ps is decreased, and the pressure Pc in the crankcase interior 109 decreased accordingly. At this moment, the opening of the second shutoff valve 69 is sufficiently large to rapidly decrease the pressure in the crankcase interior 109 substantially in synchronism with the decrease of the suction pressure Ps. As a result, the pressure difference $\Delta p$ is kept substantially at a fixed value to maintain the full displacement operating state.

Figure 6:
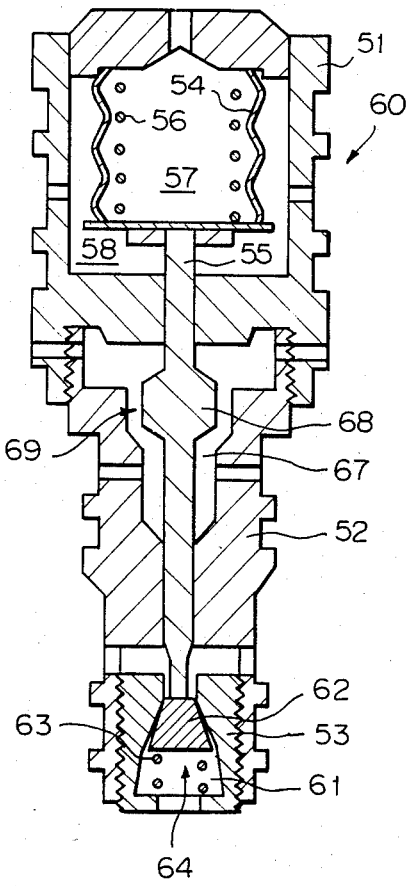
FIGS. 6 and 7 are enlarged cross-sectional views for describing the operation of the valve control unit.
Figure 7:
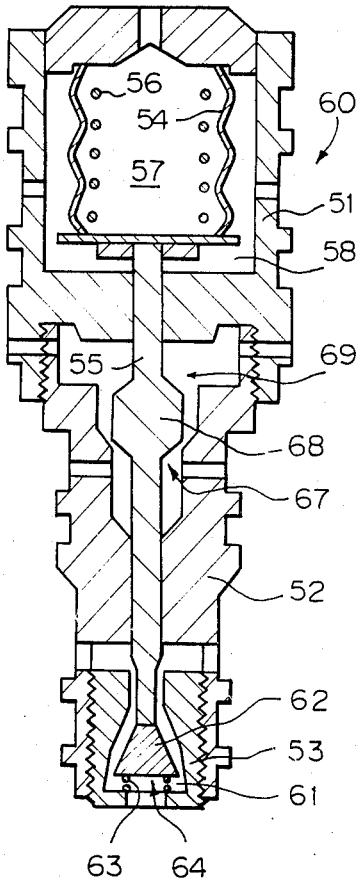

If the temperature in the vehicle cabin is further lowered to reduce the cooling load, and if the pressure Pc in crankcase interior 109 and the suction pressure Ps are lowered to dècrease the pressure Pc in the crankcase interior 109 to below the set value (2.7 atm), the pressure in the pressure sensitive chamber 58 is also decreased to allow the bellows 54 to be extended by the spring 56. The front end of the actuating rod 55 is in contact with the valve element 62 as shown in FIG. 6 and thus pushes the valve element 62 downward as shown in FIG. 7 to open the gas passage 65. Accordingly, high-pressure gas flows from the discharge chamber 106 through the gas passage 65 into the crankcase interior 109 to stop the decrease of the pressure Pc in the crankcase interior 109. Under this condition, the opening of the second shutoff valve 69 is small due to the valve element 68 so that the amount of refrigerant gas sent from the crankcase interior 109 back to the suction chamber 104 is reduced, to rapidly return the pressure in the crankcase interior 109 to the set value.

On the contrary, if the pressure Pc in the crankcase interior 109 exceeds the set value due to the high-pressure gas having a discharge pressure Pd sent through the gas passage 65 under the situation shown in FIG. 7, the actuating rod 55 is moved upward to close the gas passage 65 by the valve element 62 of the first shutoff valve 64 so that the increase of the pressure Pc in the crankcase interior 109 may be stopped. At this moment, the valve element 68 of the second shutoff valve 69 is moved upward together with the actuating rod 55 to rapidly lower the pressure Pc in the crankcase interior 109 to the set value. In this way, the pressure Pc in the crankcase interior 109 can automatically, rapidly, and correctly be held substantially at the set value during an ordinary operation.

If the temperature in the vehicle cabin is lowered to further reduce the cooling load, the suction pressure Ps is decreased regardless of the pressure Pc in the crankcase interior, which is kept at the set value as mentioned before. When the pressure difference $\Delta p$ between the pressure Pc in the crankcase interior 109 and the suction pressure Ps exceeds a predetermined value (for instance, 0.5 atm), the stroke of each piston 113 is reduced, and the inclination of the wobble plate 119 is also reduced, so that the operation will be changed to a small displacement operation.

On the other hand, if a vehicle engine is suddenly accelerated to rapidly increase the revolution speed of the drive shaft 110 during a full displacement operation, the suction pressure Ps is decreased, and the pressure Pc in the crankcase interior 109 is also rapidly decreased, because the opening of the second shutoff valve 69 is large. Accordingly, the variation of the pressure difference Δp becomes small and causes only a slight reduction in the comopressor displacement.

During the full displacement operation in which the opening of the valve element 68 of the second shutoff valve 69 is large, if an engine brake is actuated and the suction pressure Ps rapidly becomes higher than the pressure Pc in the crankcase interior 109, the gas quickly flows from the suction chamber 104 into the crankcase interior 109 so that the variation of the pressure difference Δp may become small and cause only a slight reduction in the compressor displacement. If the compressor is restored to the ordinary operation and the suction pressure Ps is lowered, the gas flows rapidly from the crankcase interior 109 back to the suction chamber 104 so that the pressure difference Δp is restored to the predetermined value to quickly return to the full displacement operation.

In this embodiment, even if the amount of gas sent from the compression chamber of each cylinder bore into the crankcase interior 109 due to a blowby caused by the excessive cooling load, which causes the pressure in compression chamber to increase to a high value under a situation wherein the first shutoff valve 64 is closed, the opening of the second shutoff valve 69 is sufficiently large to prevent the pressure Pc in the crankcase interior 109 from increasing and to keep the pressure Pc substantially at a fixed value.

Figure 8:
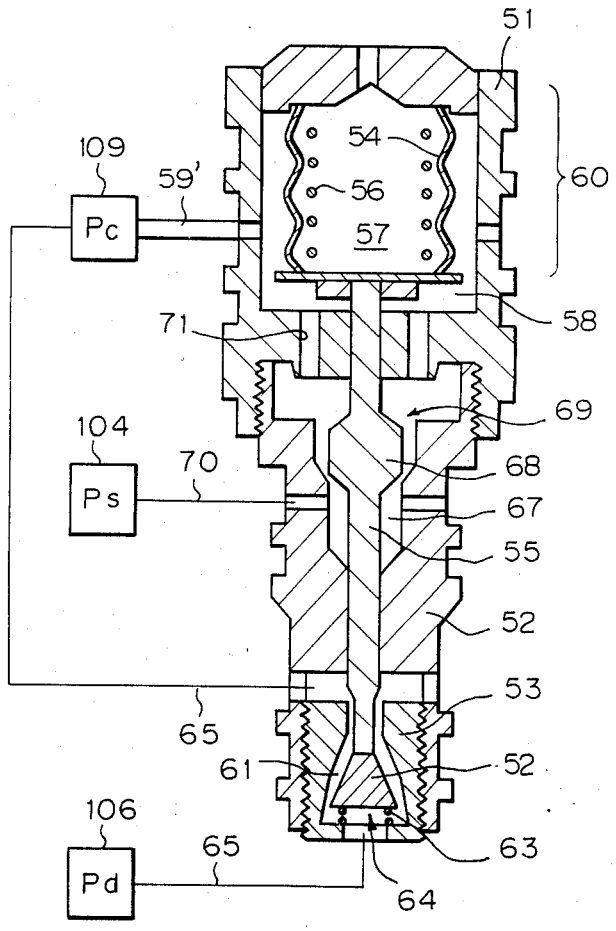
FIG. 8 is an enlarged cross-sectional view showing a variation of the valve control unit.

FIG. 8 shows a variation of the control valve 50 in which the crankcase interior 109 communicates with the pressure sensitive chamber 58 through a connecting passage 59' having a large cross-sectional passage area, and the pressure sensitive chamber 58 communicates with the valve chest 67 through one or a plurality of passage(s) 71 having large cross-sectional passage area(s). This example differs from the previous embodiment in that the connecting passage 59', pressure sensitive chamber 58, and passage 71 commonly form a part of the extraction passage 70.

From the foregoing description of the second embodiment of the present invention, it will be understood that, according to the present invention, the pressure in the crankcase interior is maintained at a set value, unnecessary variation of the displacement reduced, and the control of displacement promptly performed at the time when a pressure difference between the pressure in the crankcase interior and the suction pressure varies, thereby improving the displacement control characteristic during the ordinary operation, or when a sudden deceleration is performed due to, for instance, the operation of an engine brake or by driving a vehicle equipped with the compressor from a highway to a parking lot, or when the ordinary operation is restored after the completion of a sudden acceleration.

It should be understood that various modifications and variations will occur to a person skilled in the art without departing from the scope of the appended claims.

We claim:

1. A variable displacement wobble plate type compressor comprising:

a suction chamber for a refrigerant; a plurality of cylinder bores arranged so as to surround an axial drive shaft and having therein associated reciprocatory pistons disposed so as to draw the refrigerant from the suction chamber and to then discharge the refrigerant after compression in a discharge chamber; a crankcase having defined herein a chamber communicating with the cylinder bores and containing therein a drive plate mounted in such a manner that it is capable of rotating with the axial drive shaft as well as changing an inclination thereof with respect to the axial drive shaft and a non-rotating wobble plate held by the drive shaft; a plurality of connecting rods connected between the wobble plate and pistons; a first passageway means for communicating said chamber of said crankcase with said discharge chamber; a first valve means arranged in said first passageway means, for opening and closing said first passageway means; a second passageway means for always providing a continuous fluid communicating between said chamber of said crankcase and said suction chamber, and; valve control means for controlling the operation of said first valve means in response to a change in fluid pressure in said chamber of said crankcase with respect to a predetermined pressure level, said valve control means being mechanically coupled with said first valve means and directly actuable in response to the pressure in the chamber of said crankcase for moving said first valve means to a first position opening said first passageway means when pressure in said chamber of said crankcase is less than said predetermined pressure level, and to a second position closing said first passageway means when said pressure in said chamber of said crankcase is larger than said predetermined pressure level.

2. A variable displacement wobble plate type compressor according to claim 1, wherein said cylinder bores are formed in a cylinder block having a first end to which said crankcase is fluid-tightly connected and a second end to which a compressor head having therein said suction and discharge chambers is fluid-tightly connected, via a valve plate, said cylinder block and said valve plate having at least one through-hole axially extending therethrough to form said second passageway means, thereby extracting fluid from said chamber of said crankcase into said suction chamber.

3. A variable displacement wobble plate type compressor according to claim 2, wherein said cylinder block, said compressor head, and said valve plate have a continuous fluid passageway extending from said discharge chamber to said chamber of said crankcase to form said first passageway means, said continuous fluid passageway having a valve seat of said first valve means formed at a portion thereof.

4. A variable displacement wobble plate type compressor according to claim 3, wherein said continuous fluid passageway includes a bearing receipt bore formed centrally and axially in said cylinder block so as to support said axial drive shaft, via a bearing providing a clearance gap in communication with said bearing receipt bore and said chamber of said crankcase.

5. A variable displacement wobble plate type compressor according to claim 3, wherein said first valve means comprises a spring loaded ball valve element urged toward said second position whereat said ball valve element is seated against said valve seat, and an actuating rod arranged so as to be extended between said ball valve element and said valve control means.

6. A variable displacement wobble plate type compressor according to claim 5, wherein said valve control means comprises pressure sensitive resilient means responsive to the change in said fluid pressure in said chamber of said crankcase with respect to said predetermined pressure level, said pressure sensitive resilient means being mounted in a recess formed in said head and operatively connected to said actuating rod of said first valve means.

7. A variable displacement wobble plate type compressor according to claim 1, further comprising a second valve means arranged in said second passageway means, for varying the opening of said second passageway means, said second valve means being operatively connected to said valve control means, said valve control means moving said second valve means to a first position narrowing said second passageway means when pressure in said chamber of said crankcase is less than said predetermined pressure level, and to a second position expanding said second passageway means when said pressure in said chamber of said crankcase is larger than said predetermined pressure level.

8. A variable displacement wobble plate type compressor according to claim 7, wherein said first valve means comprises a valve seat provided in said first passageway means, a valve element cooperable with said valve seat to open and close said first passageway means, a resilient element constantly urging said valve element toward said valve seat and an actuating element operable to move said valve element away from said valve seat against said resilient element, and wherein said second valve means comprises a valve chest provided in said second passageway means, a valve element cooperable with said valve chest to extend and narrow said second passageway means, and an actuating element operable to move said valve element toward and away from said valve chest.

9. A variable displacement wobble plate type compressor according to claim 8, wherein said first valve means further comprises a filter element arranged adjacent to said valve seat.

10. A variable displacement wobble plate type compressor according to claim 8, wherein said actuating element of said first valve means and said actuating element of said second valve means are formed in an integral element arranged on a common rod member operatively connected to said valve control means.

11. A variable displacement wobble plate type compressor according to claim 10, wherein said valve control means comprises pressure sensitive resilient means responsive to the change in said fluid pressure in said chamber of said crankcase with respect to said predetermined pressure level, said pressure sensitive resilient means being operatively connected to said rod member of said first and second valve means, thereby moving both said actuating elements of said first and second valve means.

12. A variable displacement wobble plate type compressor according to claim 10, wherein said first and said second valve means and said valve control means are coaxially accommodated in a substantially cylindrical casing to form an integral wobble angle control unit.

13. A variable displacement wobble plate type compressor according to claim 12, wherein said integral wobble angle control unit is accommodated in a body of said compressor.

14. A variable displacement wobble plate type compressor comprising:

a suction chamber for a refrigerant;

a plurality of cylinder bores arranged so as to surround an axial drive shaft and having therein associated reciprocatory pistons disposed so as to draw the refrigerant from the suction chamber and to then discharge the refrigerant after compression in a discharge chamber;

a crankcase having defined therein a chamber communicating with the cylinder bores and containing therein a drive plate mounted in such a manner that it is capable of rotating with the axial drive shaft as well as changing an inclination thereof with respect to the axial drive shaft and a non-rotating wobble plate held by the drive shaft;

a plurality of connecting rods connected between the wobble plate and pistons;

a first passageway means for communicating said chamber of said crankcase with said discharge chamber;

a first valve means arranged in said first passageway, means, for opening and closing said first passageway means, said first valve means including a valve seat provided in said first passageway means, a valve element cooperable with said valve seat to open and close said first passageway means, a resilient element constantly urging said valve element toward said valve seat and an actuating element operable to move said valve element away from said valve seat against said resilient element;

a second passageway means for fluidly communicating said chamber of said crankcase with said suction chamber;

a second valve means arranged in said second passageway means, for varying the opening of said second passageway means, said second valve means including a valve chest provided in said second passageway means, a valve element cooperable with said valve chest to extend and narrow said second passageway means, and an actuating element operable to move said valve element toward and away from said valve chest;

valve control means for controlling the operation of said first valve means in response to a change in fluid pressure in said chamber of said crankcase with respect to a predetermined pressure level, said valve control means moving said first valve means to a first position opening said first passageway means when pressure in said chamber of said crankcase is less than said predetermined pressure level, and to a second position closing said first passageway means when said pressure in said chamber of said crankcase is larger than said predetermined pressure level, said second valve means being operatively connected to said valve control means, said valve control means moving said second valve means to a first position narrowing said second passageway means when pressure in said chamber of said crankcase is less than said predetermined pressure level, and to a second position expanding said second passageway means when said pressure in said chamber of said crankcase is larger than said predetermined pressure level;

said actuating element of said first valve means and said actuating element of said second valve means being formed in an integral element arranged on a common rod member operatively connected to said valve control means;

said valve control means further including pressure sensitive resilient means responsive to the change in said fluid pressure in said chamber of said crankcase with respect to said predetermined pressure level, said pressure sensitive resilient means being operatively connected to said rod member of said first and second valve means, thereby moving both said actuating elements of said first and second valve means, said pressure sensitive resilient means having a pressure sensitive chamber means connected to said chamber of said crankcase, a bellows means forming therein an atmospheric chamber communicated with an atmosphere, a spring means arranged in said atmospheric chamber for applying a predetermined force to extend said bellows means, and a plate means attached to said bellows means and said rod element of said first and second valve means.

* * * * *